United States Patent [19]

Hurtz et al.

[11] Patent Number: 4,696,600

[45] Date of Patent: Sep. 29, 1987

[54] METHOD AND APPARATUS FOR MODIFYING THE CROSS-SECTIONAL PROFILE OF AN ADIT, TUNNEL OR THE LIKE

[75] Inventors: Georg Hurtz, Erkelenz-Holzweiler; Willi Steufmehl, Erkelenz; Wolfgang Krappen, Wassenberg, all of Fed. Rep. of Germany

[73] Assignee: Wirth Maschinen- Und Bohrgerate-Fabrik GmbH, Erkelenz, Fed. Rep. of Germany

[21] Appl. No.: 848,047

[22] PCT Filed: Jun. 10, 1985

[86] PCT No.: PCT/DE85/00199

§ 371 Date: Feb. 12, 1986

§ 102(e) Date: Feb. 12, 1986

[87] PCT Pub. No.: WO86/00113

PCT Pub. Date: Jan. 3, 1986

[30] Foreign Application Priority Data

Jun. 12, 1984 [DE] Fed. Rep. of Germany ..... 3421704

[51] Int. Cl.[4] ..... E01G 3/04

[52] U.S. Cl. ..... 405/138; 299/31; 405/142; 405/303

[58] Field of Search ..... 405/138, 141, 146, 150, 405/142, 303; 299/31, 71, 57

[56] References Cited

U.S. PATENT DOCUMENTS

| | | | |
|---|---|---|---|
| 3,695,717 | 10/1972 | Birrer | 405/138 X |
| 4,185,873 | 1/1980 | Bohnes et al. | 299/31 |
| 4,514,012 | 4/1985 | Wallace | 299/31 X |

FOREIGN PATENT DOCUMENTS

| | | | |
|---|---|---|---|
| 1261459 | 2/1968 | Fed. Rep. of Germany . | |
| 1260412 | 2/1968 | Fed. Rep. of Germany . | |
| 2127186 | 12/1972 | Fed. Rep. of Germany . | |
| 2507984 | 9/1976 | Fed. Rep. of Germany . | |
| 2939087 | 4/1981 | Fed. Rep. of Germany | 405/138 |
| 3121244 | 12/1982 | Fed. Rep. of Germany | 405/138 |
| 3125082 | 1/1983 | Fed. Rep. of Germany | 405/138 |
| 3151060 | 7/1983 | Fed. Rep. of Germany . | |
| 2001904 | 10/1969 | France . | |
| 2289720 | 5/1976 | France . | |

*Primary Examiner*—Dennis L. Taylor

*Attorney, Agent, or Firm*—Holman & Stern

[57] ABSTRACT

To modify a given profile of an adit, tunnel, gallery or the like, particularly a circular profile so as to give it the shape of a vault, a sequence of individual recesses are made in the longitudinal direction in the wall of the adit by a boring head advanced in the direction of its axis of rotation and transversely to the longitudinal direction of the adit. The recesses preferably overlap one another. Apparatus for implementing the method comprises a heading device for moving in the direction of the wall of the adit a boring head provided at its front end with tools.

23 Claims, 5 Drawing Figures

METHOD AND APPARATUS FOR MODIFYING THE CROSS-SECTIONAL PROFILE OF AN ADIT, TUNNEL OR THE LIKE

CROSS REFERENCE TO RELATED APPLICATION(S)

This U.S. application stems from PCT International Application No. PCT/DE85/00199 filed June 10, 1985.

1. Technical Field

The invention relates to a method and an apparatus for modifying the cross-sectional profile, in particular the circular profile, of an adit, tunnel, gallery or the like, by widening the profile in partial areas thereof by means of a tool which can be driven in a rotating manner.

In numerous cases it is desired or necessary to make a subsequent alteration to a cross-sectional profile—as initially existing—of a gallery or the like, in order to attain a final profile which meets specific demands. This applies particularly in the case of galleries or the like which have a circular cross-section, resulting in many cases from the nature of the advance, namely by heading by means of a full-cut heading machine, while a horseshoe shape is required as the final profile as may be the case for example in railway or road tunnels.

2. State of the Art

Heading machines are known in which tools are mounted for example on radially adjustable arms, or machines which comprise small boring heads arranged parallel to a main boring head and orientated in the same direction, in order to produce additional profile areas. Apart from the fact that such devices are often very complicated, there are usually also disadvantageous power ratios. Thrust forces must normally always be introduced into the side of a gallery or the wall of an adit by way of the holding elements of the machine, i.e. with a turn through 90°.

DISCLOSURE OF INVENTION

The object of the invention is to disclose an advantageous possibility of modifying an existing profile of a gallery, adit or the like in a manner which meets the numerous cases of requirement. In particular, it should be possible to alter a circular profile subsequently in such a way as to produce an essentially arcuate profile or a profile approximately in the shape of an inverted U. In addition to a method for this purpose the invention also aims to disclose an apparatus by means of which the modification of such an existing profile can be carried out in an advantageous manner. Additional, related problems, with which the invention is concerned, may be seen in the respective explanation of the solution disclosed.

The invention provides that with at least one boring head or a similar tool unit a sequence of individual recesses extending in the longitudinal direction of the adit is produced in the wall of the adit, the boring head having imparted to it in each case an advancing movement in the direction of its axis of rotation and transversely to the longitudinal direction of the adit, in particular perpendicular or substantially perpendicular to a tangent on the adit profile or to the wall of the adit. In particular the recesses are formed in such a way that they overlap one another.

An apparatus for finishing the outer limit of a tunnel, adit or the like, in particular for carrying out the method disclosed, is characterized according to the invention by a support frame, a holding device associated with the support frame and having holding shields or the like which can be pressed against the wall of the adit, at least one bearing housing or the like with a boring head or a similar tool unit, the front face of which is provided with tool elements and is turned to face the wall of the adit during operation, and by a heading device to impart to the boring head an operative movement in the direction of the wall of the adit.

The tool elements of the boring head may be of different types, as best meets the circumstances in question, i.e. the nature of the rock. Roller bits or cutting rollers, for example with teeth, studs, discs etc., or even knives or other cutting tools can be provided.

When the term "adit" is used in the description and in the claims, this should also be taken to include tunnels, galleries and other corresponding or similar spaces, in which it is possible for the invention to be applied. No restriction is implied therefore by these expressions.

Further details, features and advantages of the invention may be seen in the following explanation of embodiments, the accompanying drawing and the claims. In the drawing FIG. 1 shows an embodiment of the apparatus according to the invention viewed in the operating position in an adit;

Figure 1:
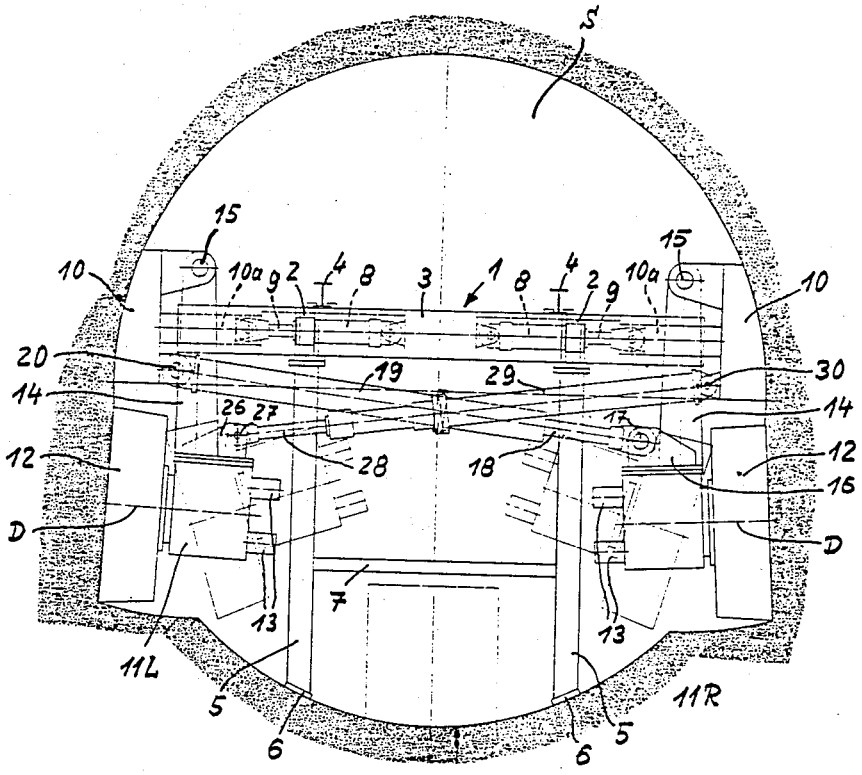
Figure 2:
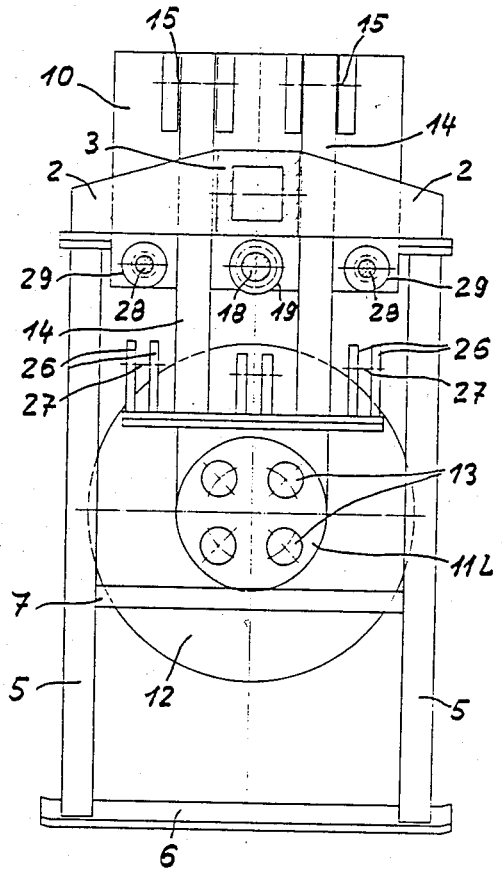
FIG. 2 is a section along the line II—II in FIG. 1.

The apparatus illustrated in FIGS. 1 and 2 (for the sake of clarity, some components have been shown in FIG. 2 in a different position or have been omitted as compared with FIG. 1) comprises a support frame designed as a whole by reference numeral 1, in which a transverse member 3 is held by plates 2 and profile supports 4 indicated only in FIG. 1. The plates 2 are connected to uprights 5, two of which in each case are connected to one another at their lower ends by a runner 6. Transverse struts between the uprights 5 have been given the nuneral 7. Such a frame can therefore rest with the runners 6 on the floor area of an adit S.

The adit S originally has a circular profile in cross-section, as produced by heading with a full-cut heading machine, tunnel-boring machine or the like.

Two holding cylinders 8, the piston rods 9 of which are connected in an articulated manner to rearward extensions 10*a* on holding shields 10 guided in the transverse member 3, are disposed in the transverse member. By moving the piston rods 9 out of the cylinders 8 the holding shields 10 can thus be pressed against the wall of the adit, so that the apparatus is thereby held tight in the adit. It is also possible to provide a holding cylinder on only one side and to mount the holding shield rigidly on the other side. The presence of two holding cylinders 8 offers more possibilities, however, and also makes it possible to withdraw the apparatus from the centre.

The numerals 11R and 11L designate a right-hand and a left-hand bearing housing. Each of them contains the main bearing for a boring head 12 and at the same time forms a transmission housing with drive motors 13 flange-mounted thereon, hydraulic motors or even electric motors being possible. Each boring head 12 can be driven at a rotary speed suitable for the case in question.

Its axis of rotation has been given the letter D in each case.

Each bearing housing 11R and 11L is suspended on two pivot arms 14 which are held in an articulated manner in a pivot bearing 15. The pivot bearings 15, about the centre of which the bearing housings 11R and 11L with the boring heads 12 can thus pivot, are situated on the rear faces of the holding shields 10, namely in their upper portion in each case.

The end of a piston rod 18 is articulated on a pivot bearing 17 received by two joint sheets 16 on the right-hand bearing housing 11R. The end of the cylinder 19 of the said piston rod 18 is held in an articulated manner in a pivot bearing 20 which is situated in the lower part of the holding shield 10 opposite the bearing housing 11R.

The left-hand bearing housing 11L comprises two pairs of joint sheets 26 with pivot bearings 27 for the ends of two piston rods 28, the cylinders 29 of which are held at their ends in pivot bearings 30 which are disposed in the lower part of the opposite holding shield 10.

Each of the piston-cylinder units 18, 19 and 28, 29 is double-acting. Hydraulic cylinders are preferably involved here. Their pressure medium connexions are not shown. By supplying pressure medium to one or other end of the cylinder 19, the right-hand bearing housing 11R can be pivoted by the pivot arms 14 about the articulation point 15 and in this way are transferred for example from a rest position indicated in thin lines in FIG. 1 into an operative position indicated in heavy lines and vice versa. The same applies to a pivoting of the left-hand bearing housing 11L about the respective articulation point 15 by appropriate supply of pressure medium to one or other end of the parallel cylinders 29.

The cylinders 19 and 29 are dimensioned such that the same force can be applied with the two cylinders 29 as with the cylinder 19. The use of two cylinders for one of the two bearing housings has the advantage of symmetry.

By means of the cylinders 19 and 29 not only are the boring heads 12 brought from a rest position onto the wall of the adit, but the advancing movement of the boring heads 12 is also effected during operation, it being possible to set the level of the advancing force by appropriate selection of the pressure of the pressure medium supplied to the cylinders 19 and 29. In this connexion the reaction force is introduced directly into the rock by way of the pivot bearings 20 and 30 and the holding shields 10. This is particularly advantageous. It is not therefore necessary for the force to be turned, as is otherwise the case.

A modified embodiment within the scope of the invention consists in the ends of the advancing cylinders 19 and 29 not acting directly upon the holding shields 10 but being articulated at suitable points on the transverse member 3. In this case too the force is introduced into the rock in an advantageous manner, the holding cylinders 8 then having to transmit the thrust forces.

Figure 3:
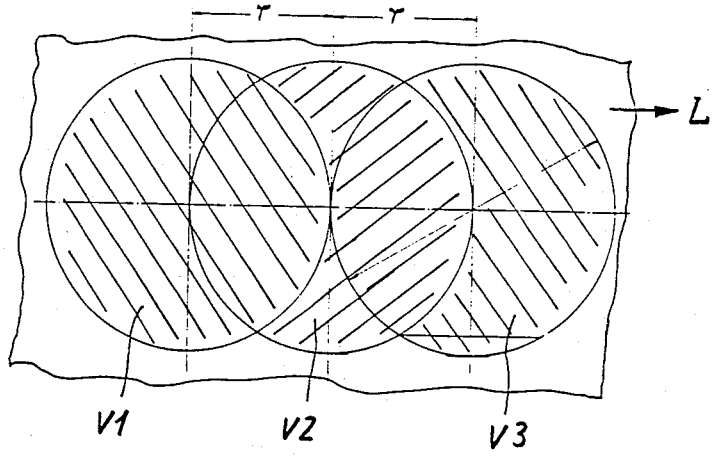
FIG. 3 is a diagrammatic view to illustrate the method.

FIG. 3 shows the operation in accordance with the method according to the invention, which is possible inter alia with an apparatus of the type described above. A first recess V1 is bored into the audit wall by means of the boring head which is shown in plan view as in FIG. 3 and in section for example as in FIG. 1. The boring head in question is then retracted and is moved forward in the longitudinal direction L of the adit by the apparatus carrying it by an amount which can be selected according to the circumstances, after which the next recess V2 (FIG. 3) is then bored. After this the boring head is again moved and then a further recess V3 etc. is bored, so that an extension running in the longitudinal direction of the adit and thus the desired alteration of the sectional shape into an inverted U or the like are produced. In FIG. 3 the respective movement of the boring head for boring the next recess is equal to the radius r of the effective operating area of the boring head. This amount can be different, however, depending upon the circumstances.

In addition, the diameter of the boring head or its operating area can be selected in accordance with the respective requirements. In can, in particular, lie in the range of between approximately 40% and 80% of the radius of an originally circular adit profile. In many cases a range of between approximately 50% and 60% is advantageous.

The movement of an apparatus of the type illustrated in FIGS. 1 and 2 can be carried out in various ways after releasing the holding. The apparatus can be brought up with a pulling means, while sliding on the runners 6, it can be suspended on a propulsion machine, in particular with one or more restoring cylinders in the connexion, or it can also form part of a propulsion machine.

In the embodiment illustrated, the support structure with the uprights 5 and the struts 6 has practically only one function during changing. It then bears the weight of the apparatus. During operation the forces can be absorbed by the transverse member with the holding action.

The support structure is designed in such a way that in the lower area a free space is present as in the case of a gantry. This free space can also be used as a passage, for example in order to reach a propulsion machine positioned in the adit in front of the apparatus.

An apparatus of the type according to the invention can, in particular, be positioned directly behind a boring head, namely behind an enlarging boring head, the machine body of which is disposed in an advance borehole. An extension can then be placed directly behind the apparatus in the adit or in the gallery, without fastening measures being required in the meantime. It is also possible in each case for a shield to be associated with the apparatus, at least in the roof of the adit. Such a shield without any other protective cover can be mounted on the apparatus itself or on a part adjacent thereto, for example of a following trailer or the like.

Figure 4:
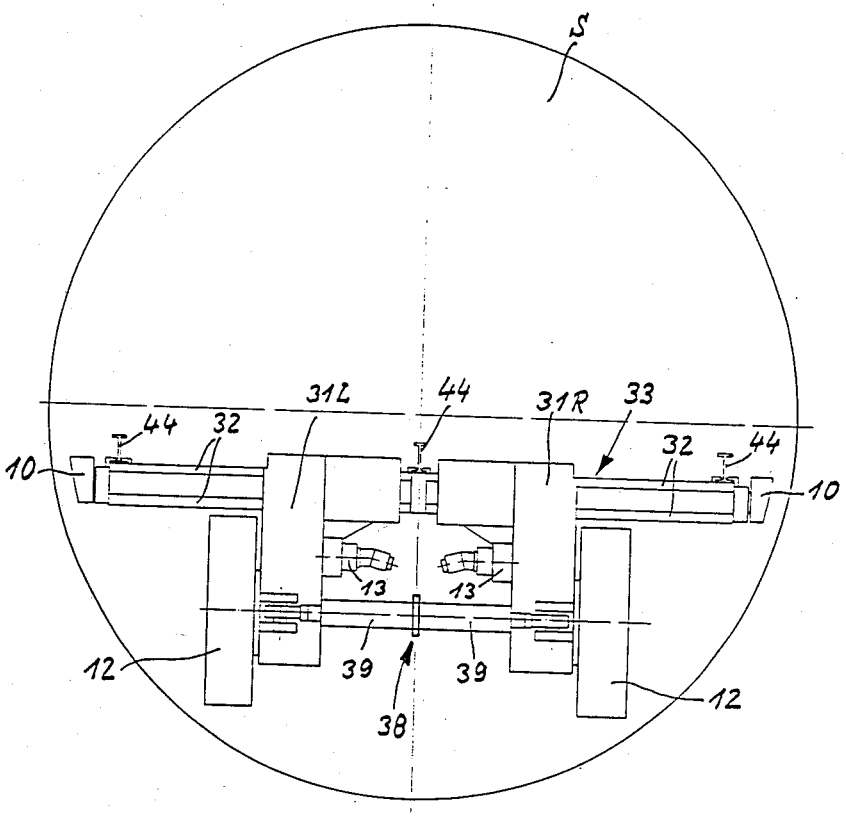
FIG. 4 shows another embodiment of the apparatus according to the invention viewed before depolyment.
Figure 5:
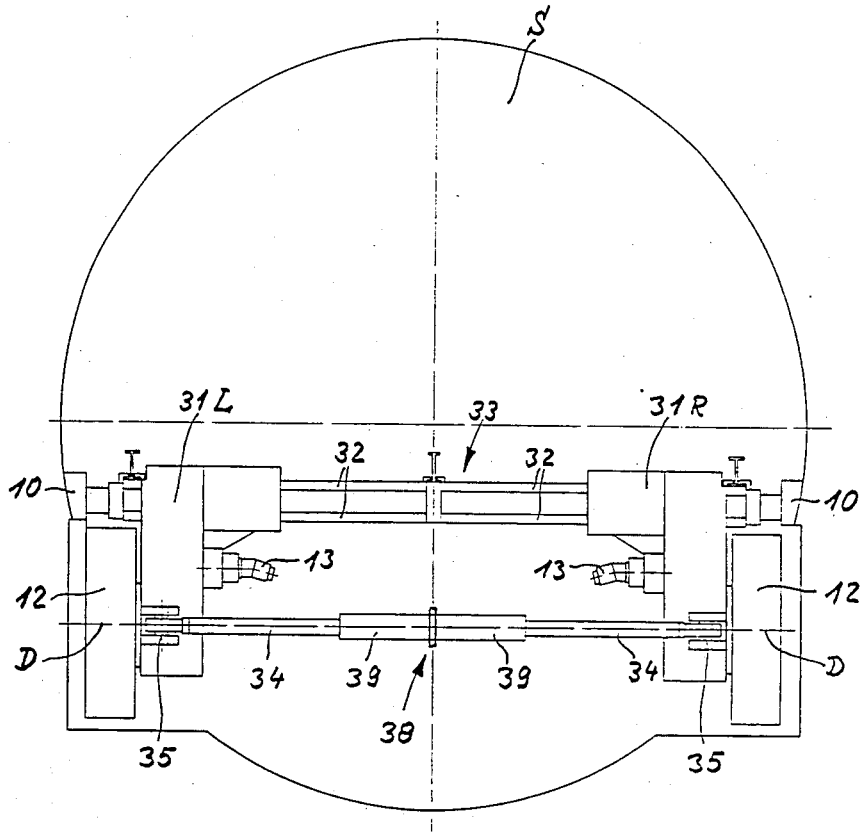
FIG. 5 shows the apparatus according to FIG. 4 after the formation of recesses.

What has been stated in principle above in connexion with the method and the apparatus also applies in a similar manner to the embodiment of an apparatus illustrated in FIGS. 4 and 5, which will be described below. In this connexion the same or similar elements which are also present in the apparatus according to FIGS. 1 and 2 will not be described again in detail.

A transverse member 33 with hydraulically extensible holding shields 10 at the ends is held by a support frame (support 44) and is constructed on both sides as a guide 32 for bearing and transmission housings 31L and 31R longitudinally displaceable thereon. Drive motors are designated 13. By displacing the housings 31L and 31R with the boring heads 12 mounted therein the latter can be moved out of the rest position according to FIG. 4 into an operative position.

In this embodiment the engagement and advancing movement is produced by mutually aligned piston-cylinder units 38 which extend between the housing 31R and 31L and the cylinders 39 of which are joined at their ends adjacent to one another to form a unit and the piston rods 34 of which engage on the housings 31R and 31L by way of pivot bearings 35. Double units 38 of this type are preferably provided on each side of the two housings.

In addition, such an embodiment has the advantage that the power flow is not subjected to any turning, but the thrust forces are immediately absorbed.

All the features mentioned in the above description or illustrated in the drawing should, insofar as permitted by the known state of the art, be regarded as being covered, either individually or in combination, by the invention.

We claim:

1. A method of modifying a cross-sectional profile of an adit, tunnel gallery or like elongate aperture comprising widening the profile in selected areas thereof with a rotary boring head having an axis of rotation oriented transversely to a longitudinal axis of the aperture and to which a feed movement can be imparted in the direction of said axis of rotation, the method including the steps of using the boring head to bore a first recess in a wall of the aperture by imparting the feed movement to the boring head, retracting the boring head, moving the boring head forward in the lengthwise direction of the aperture, then using the boring head to form another recess in the wall of the aperture overlapping the first recess, the boring, retracting, and forward moving steps of the boring head being repeated in such a manner that a plurality of individual recesses overlapping one another is produced in the wall of the aperture as a sequence extending in the lengthwise direction of the aperture.

2. Apparatus for modifying a cross-sectional profile of an adit, tunnel, gallery or like elongate aperture by widening the profile in selected areas thereof, the apparatus comprising a support frame, a holding device associated with the support frame, the holding device having holding shields to be pressed against the wall of the aperture, at least one bearing housing suspended on a pivot arm which is pivotable in a plane substantially perpendicular to the longitudinal axis of the aperture, the bearing housing having a boring head, drive means associated with the bearing housing for rotating the boring head, the boring head having an axis of rotation substantially perpendicular to a tangent or cross-section of the aperture so that a front face of the boring head which is provided with tool elements, is oriented to face the wall of the aperture during operation, and a feeding device for imparting an operating feed movement to be boring head, the feeding device engaging at one end on the bearing housing and at an opposite end at least indirectly on the support frame.

3. Apparatus according to claim 2 wherein the pivot arm has an articulation point disposed on one of the holding shields.

4. Apparatus according to claim 2 wherein the feeding device engages at an opposite end on a holding shield.

5. Apparatus according to claim 2 wherein the support frame is provided with supporting legs.

6. Apparatus according to claim 2 wherein the effective diameter f the boring head is in the region of approximately 40% to 80% of the radius of a circular aperture profile.

7. Apparatus according to claim 6 wherein the effective diameter of the boring head is in the region of approximately 50% to 60% of the radius of a circular aperture profile.

8. Apparatus according to claim 2 wherein the apparatus is a part of a heading machine.

9. Apparatus according to claim 2 wherein the apparatus has a towing connection with a heading machine or like unit associated therewith.

10. Apparatus according to claim 9 wherein the connection comprises at least one piston-cylinder unit.

11. Apparatus according to claim 2 wherein the apparatus is disposed directly behind a boring mechanism of a heading machine.

12. Apparatus according to claim 2 wherein the apparatus is covered at least in a roof area by a shield or the like.

13. Apparatus for modifying a cross-sectional profile, of an adit, tunnel, gallery or like elongate aperture by widening the profile in selected areas thereof, the apparatus comprising a support frame, a holding device associated with the support frame, the holding device having holding shields to be pressed against the wall the of aperture, at least one bearing housing supported at least indirectly by the support frame, the bearing housing having a boring head, drive means associated with the bearing housing for rotating the boring head, the bearing housing being displaceable on a rectilinear guide, the boring head having an axis of rotation aligned in the direction of displacement of the bearing housing so that a front face of the boring head provided with tool elements is oriented to face the wall of the aperture during operation, and a feeding device for imparting an operative feed movement to the boring head, the feeding device engaging at one end on the bearing housing.

14. Apparatus according to claim 13 wherein the guide is provided on a component of the support frame or is formed by said component.

15. Apparatus according to claim 13 where the feeding device engages at an opposite end on a second bearing housing.

16. Apparatus according to claim 13 wherein the support frame is provided with supporting legs.

17. Apparatus according to claim 13 wherein the effective diameter of the boring head is in the region of approximately 40% to 80% of the radius of a circular aperture profile.

18. Apparatus according to claim 17 wherein the effective diameter of the boring head is in the region of approximately 50% to 60% of the radius of a circular aperture profile.

19. Apparatus according to claim 13 wherein the apparatus is part of a heading machine.

20. Apparatus according to claim 13 wherein the apparatus has a towing connection with a heading machine or like unit associated therewith.

21. Apparatus according to claim 20 wherein the connection comprises at least one piston-cylinder unit.

22. Apparatus according to claim 13 wherein the apparatus is disposed directly behind a boring mechanism of a heading machine.

23. Apparatus according to claim 13 wherein the apparatus is covered at least in a roof area by a shield or the like.

* * * * *